US008047210B2

(12) United States Patent
Lee

(10) Patent No.: US 8,047,210 B2
(45) Date of Patent: Nov. 1, 2011

(54) HAIR EXTENSION AND HAIR EXTENSION PROCESS

(75) Inventor: Soung Jun Lee, Bogor (ID)

(73) Assignee: PT. Astika Sambo Hair International, Bogor (ID)

( * ) Notice: Subject to any disclaimer, the term of this patent is extended or adjusted under 35 U.S.C. 154(b) by 171 days.

(21) Appl. No.: 12/610,936

(22) Filed: Nov. 2, 2009

(65) Prior Publication Data

US 2011/0048445 A1 Mar. 3, 2011

(30) Foreign Application Priority Data

Sep. 3, 2009 (ID) ..... S00200900186

(51) Int. Cl.
*A41G 3/00* (2006.01)
*A41G 5/00* (2006.01)

(52) U.S. Cl. ..... 132/53; 132/201

(58) Field of Classification Search ..... 132/53–56, 132/200, 201, 203, 210; 446/319, 394; D28/92; 289/1.2, 1.5
See application file for complete search history.

(56) References Cited

U.S. PATENT DOCUMENTS

| | | | | | |
|---|---|---|---|---|---|
| 3,862,638 | A * | 1/1975 | Fannin | 132/53 |
| 4,216,777 | A * | 8/1980 | Pridemore | 606/186 |
| 4,296,765 | A * | 10/1981 | Bachtell | 132/53 |
| 4,372,330 | A * | 2/1983 | Nelson | 132/53 |
| 4,771,798 | A * | 9/1988 | Candino | 132/53 |
| 4,934,387 | A * | 6/1990 | Megna | 132/201 |
| 5,121,761 | A * | 6/1992 | Meister | 132/201 |
| 5,533,529 | A * | 7/1996 | Ohno | 132/200 |
| 5,601,099 | A * | 2/1997 | Mochizuki et al. | 132/201 |
| 7,032,602 | B2 * | 4/2006 | Chang | 132/53 |
| 7,147,009 | B1 * | 12/2006 | Murcar | 139/33 |
| 7,331,351 | B1 * | 2/2008 | Asai | 132/53 |
| 7,533,675 | B2 * | 5/2009 | Takemura | 132/201 |
| 7,992,576 | B2 * | 8/2011 | Chang | 132/201 |
| 2003/0000540 | A1 * | 1/2003 | Makino et al. | 132/201 |
| 2003/0226571 | A1 * | 12/2003 | Rahman | 132/201 |
| 2006/0090772 | A1 * | 5/2006 | Hong | 132/201 |
| 2009/0071492 | A1 * | 3/2009 | Oh | 132/201 |

FOREIGN PATENT DOCUMENTS

| | | | |
|---|---|---|---|
| DE | 10356471 | B3 | 8/2005 |
| JP | 2006-322111 | A | 11/2006 |
| WO | 2007123308 | A1 | 1/2007 |

OTHER PUBLICATIONS

Penn, R. (2004). Chapter 4 Stopper Knots. In K. McBride (Ed.), The Everything Knots Book (pp. 53). Avon, MA: F+W Publications Inc.*
Costantino, M. (2001). Chapter 3 Loops. In E. Sillwell (Ed.), The Knot Handbook (pp. 68-69, 80-81 and 90-91). New York, NY: Sterling Publishing Company, Inc.*

* cited by examiner

*Primary Examiner* — Rachel Steitz
*Assistant Examiner* — Tatiana Nobrega
(74) *Attorney, Agent, or Firm* — Roberts Mlotkowski Safran & Cole, P.C.

(57) ABSTRACT

A hair extension for attachment to a hair is provided. The hair extension comprises an extending hair portion and a thread connected to the extending hair portion and configured to be tied to a hair to create an attachment. A ring portion is formed between both ends of the thread for inserting the hair, tightening, and fixing to the inserted hair. Expensive equipment is not required for attaching and removing the hair extension.

6 Claims, 11 Drawing Sheets

HAIR EXTENSION AND HAIR EXTENSION PROCESS

CROSS-REFERENCE TO RELATED APPLICATION

The present Application claims priority from Indonesian Patent Application No. S00200900186 filed on Sep. 3, 2009 the entire content of which is incorporated herein by reference.

TECHNICAL FIELD

The present invention is related to a hair extension and hair extension process.

BACKGROUND ART

With lady's ardent hope for good, voluminous, and long hair, hair extensions are becoming popular. Such extensions connect an extending hair to a natural hair. The market for these hair extensions is expanding in both over time and diversity.

There are tube hair extension method of a strand-by-strand type, pre-bonded hair extension, and silicone glue gun hair extension type for hair extension. Among these types, the pre-bonded hair extension using hot melt series of glue with polymer or polyamide as a major ingredient is used widely.

DISCLOSURE

Technical Problem

The pre-bonded hair extension has problems such as damaging the scalp due to the glue, the peril of burning on the user due to a hot iron heated above 150 degrees Celsius, damaging the user's skin due to exposure to the glue. Moreover an expensive hot iron apparatus is needed. Also, alcohol, an industrial solvent, or a remover of based on acetone is used in removing the pre-bonded hair extension, which tend to cause skin troubles such as an allergy to the scalp or hands of the user, and it takes 4-5 hours on average for using the process due to the inefficiency of melting the glue with the hot iron and attaching while rotating the hands.

There is another method that uses an ultrasonic device for reducing the hazard associated with a hot iron, but the ultrasonic device is expensive and easily broken, and the device may cause injuries in the brain. In the tube hair extension method the hairs can be damaged or cut away when pressing with a metal tube coated with plastic. When a glue gun is used to melt silicone glue and silicone, such a glue gun has the same problems as in the pre-bonded hair extension even though it does not use expensive equipment.

An objective of the present invention is to provide a hair extension or a hair extension method, which solves problems in the widely used pre-bonded hair extension using hot-melt-related strand-by-strand type, not requiring an expensive equipment or glue, not damaging the user's skin or scalp, and not causing skin troubles or burning hazard.

Other objective of the present invention is to provide a hair extension and hair extension process, which makes it easy to attach and remove and time-saving.

Technical Solution

The hair extension according to the invention comprises an extending hair portion and a thread connected to the extending hair portion and configured to be tied to a hair under attachment, and a ring portion is formed between both ends of the thread for inserting the hair, tightening, and fixing to the inserted hair.

The ring portion preferably comprises a first ring for allowing the hair's insertion and tying the hair firstly, a second ring connected to the first ring and for allowing the hair's insertion and tying the hair secondly, and a first ring pulling portion, for pulling the first ring into the second ring, which is connected to the second ring and covers the first ring, wherein an end is disposed to stick out externally through the second ring.

In certain embodiments of the invention, the ring portion preferably comprises a first ring for allowing the hair's insertion and tying the hair firstly, a second ring connected to the first ring and for allowing the hair's insertion and secondly tying the hair as inserted into the second ring along with a part of the folded hair tied firstly, and a first ring pulling portion, for pulling the first ring toward the second ring, which is connected to the second ring and covers the first ring, wherein an end is disposed to stick out externally through the second ring.

The ring portion is formed with a first sub-ring, a first ring disposed in a direction opposite to the first sub-ring, a second sub-ring disposed in a direction opposite to the first ring, and a second ring disposed in a direction opposite to the second sub-ring obtained by folding the thread in zigzag, and preferably forms a first ring pulling portion through a step of passing an end of the thread through the second sub-ring from one side to the other side, a step of passing through the first sub-ring from the other side to the one side after skipping the first ring, a step of passing through the first sub-ring from the other side to the one side while enclosing the exterior thread portion forming the first sub-ring and changing a direction toward the second ring, a step of passing through the second sub-ring from the one side to the other side after skipping the first ring, and a step of passing through the second ring from the other side to the one side, or formed with the first sub-ring, the second ring, the second sub-ring, the first ring, and the first sub-ring with steps in a reverse order, and then the first sub-ring and the second sub-ring are tightened so as to be hooked to the first ring pulling portion leaving the first ring and the second ring.

The first ring is for forming a first knot tying the hair firstly, and the second ring is for forming a second knot which inserts a part of the hair tied at the first knot into the second ring and ties secondly.

The hair is inserted into the first ring and the second ring, and then threads on both sides of the rings are pulled in opposite directions such that the first ring picks up the hair and drags the hair into the first ring pulling portion, so that the hair is tied to the first ring pulling portion and the second ring by pulling the first ring pulling portion and second ring further.

Preferably, the hair may be tied to the first ring pulling portion and the second ring as intertwined in a shape of 'S' with the first ring pulling portion, the first ring, and the second ring.

The hair extension method according to the invention comprises extending hairs and a thread connected to the extending hairs for tying to a hair under attachment, wherein the thread is provided with a ring portion having a tightenable first ring, a tightenable second ring connected to the first ring, and a first ring pulling portion connected to the second ring and enclosing the first ring and having an end portion passing through the second ring and extending externally; inserting the hair into the first ring and the second ring; forming a first knot by tying the hair with the first ring firstly; and forming a second knot by pulling the first knot and the hair tied to the first knot toward the second ring and tying the hair with the second ring secondly.

The step of forming the second knot may comprise a step of tying to the second ring a folded part of the hair tied to the first knot and the first knot which are passed through the second ring.

In certain embodiments of the invention, the hair extension method may comprise steps of providing a hair extension comprising extending hairs and a thread connected to the extending hairs for tying to a hair under attachment, wherein the thread is provided with a ring portion having a tightenable first ring, a tightenable second ring connected to the first ring, and a first ring pulling portion which is connected to the second ring and encloses the first ring and has an end portion passing through the second ring and extending externally; inserting the hair into the first ring and the second ring; passing the first ring through the first ring pulling portion and inserting the hair, as hooked to the first ring and folded, to the first ring pulling portion; and tying the hair, as hooked to the first ring, to the first ring pulling portion and the second ring by pulling the first ring pulling portion and the second ring.

Advantageous Effects

According to the invention, expensive equipment is not required for attaching and removing the hair extension. Since glue or glue remover is not needed, there is no danger of skin trouble to the scalp or skin of the user or a service provider. There is no hazard of burning by a hot iron to the user. The hair extension service may be done within an hour; and it is quite easy to remove the hair extension.

The ring portion in the present invention is not fallen from the hair after attachment because it is intertwined and knotted with the hair of the user through two steps.

BEST MODE

The hair extension and hair extension process according to the invention is described in detail below.

Figure 1:
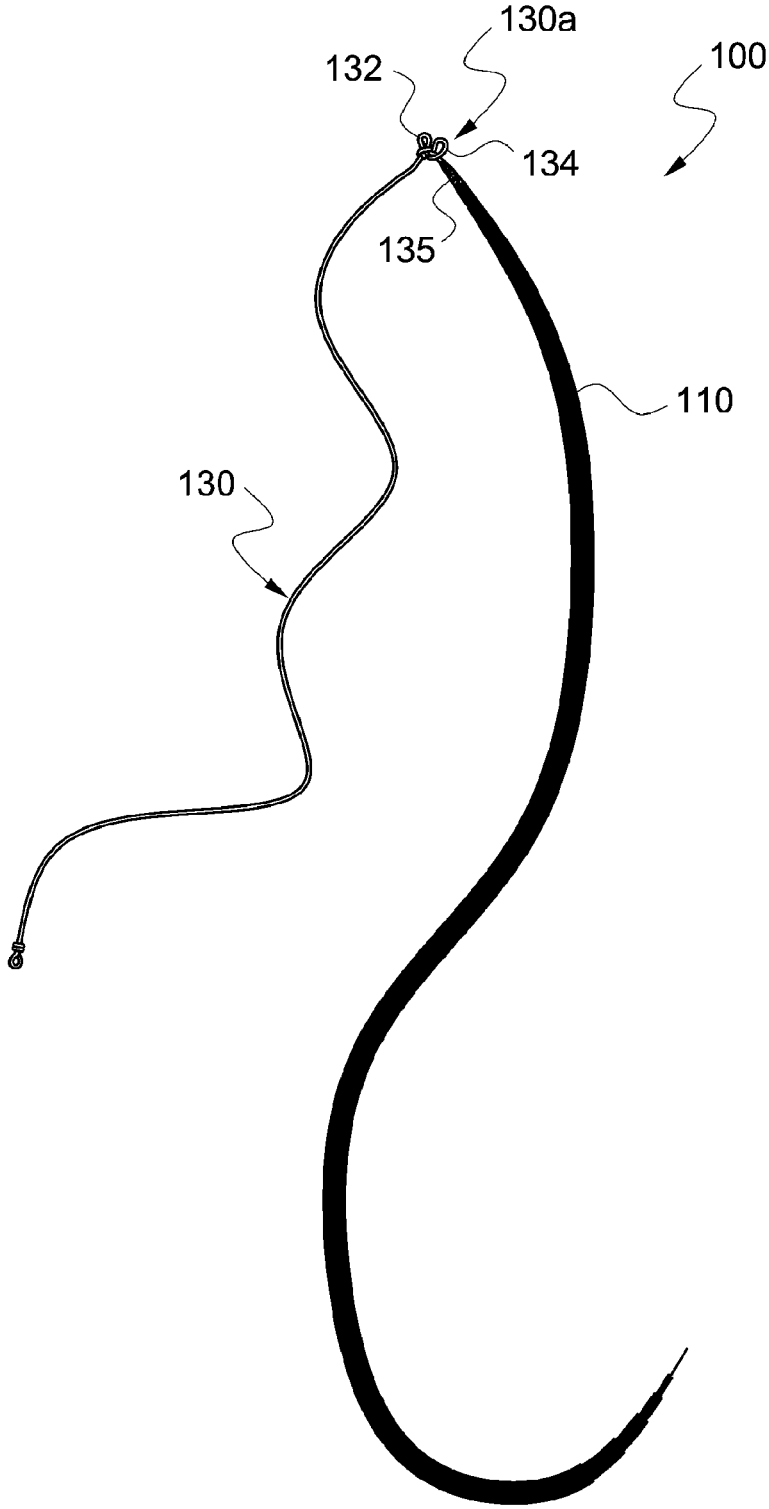
FIG. 1 is a perspective view showing a hair extension according an embodiment of the invention.
Figure 2:
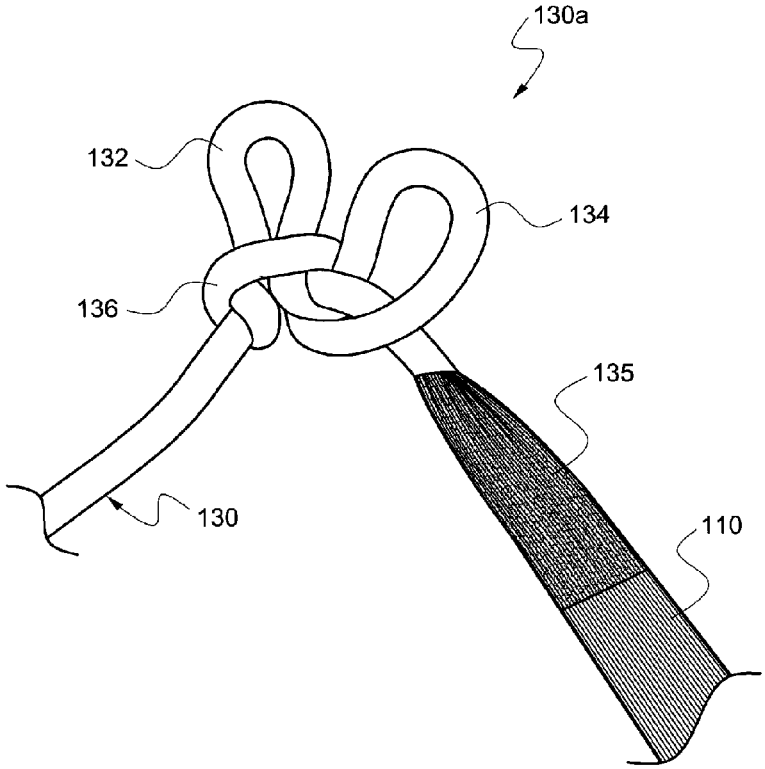
FIG. 2 is an enlarged perspective view showing a ring portion of FIG. 1.

FIG. 1 is a perspective view showing a hair extension according an embodiment of the invention, and FIG. 2 is an enlarged perspective view showing a ring portion of FIG. 1.

As illustrated, the hair extension 100 according to the invention comprises extending hairs 110. The extending hairs 110 may comprise a plurality of strands of human hairs or artificial hairs. Preferably, a thread 130 is connected to an end of the extending hairs 110. In certain embodiments of the invention, the thread 130 is connected to between both ends of the extending hairs 110. The thread 130 and the extending hairs 110 are connected to each other, preferably, by glue 135. The thread 130 is for tying to the hair under attachment, and may comprise a thread of polyester or cotton.

As illustrated, a ring portion 130*a* is formed between both ends of the thread 130. The ring portion 130*a* is for inserting the hair under attachment therein and being attached to the inserted hair by tightening, and comprises a first ring 132 for tying the hair firstly, a second ring 134 for tying secondly, and a first ring pulling portion 136 for pulling the first ring 132 toward the second ring 134. The knotting method for forming the ring portion 130*a* is described referring to FIG. 3.

Figure 3:
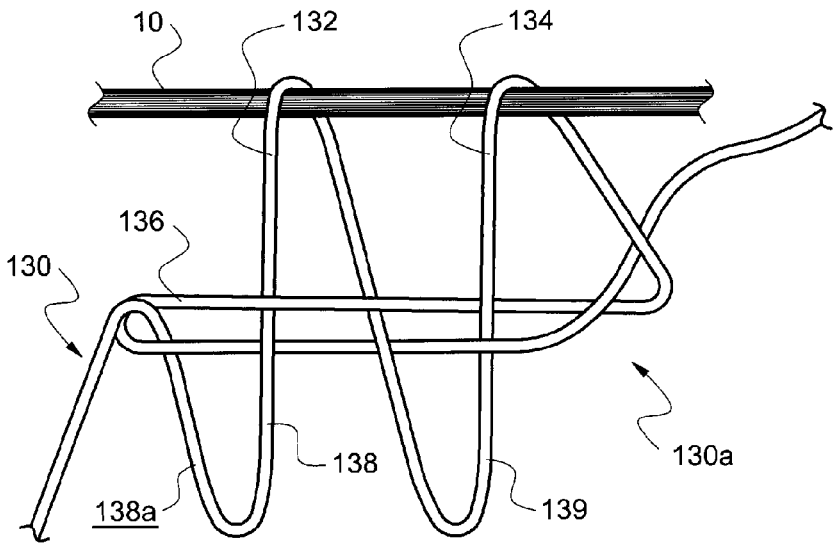
FIG. 3 illustrates how to knot the ring portion of FIG. 1.

FIG. 3 illustrates how to knot the ring portion of FIG. 1.

As illustrated, the ring portion 130*a* provided at the thread 130 comprises the first ring 132, the second ring 134 connected to the first ring 132, and the first ring pulling portion 136 which is connected to the second ring 134 and encloses the first ring 132 with its end portion passing through the second ring 134 and extending externally. Since the first ring 132 and the second ring 134 are connected to each other, with two end portions fixed, if the first ring 132 expands then the second ring 134 tightens, and if the second ring 134 expands then the first ring 132 tightens. The first ring pulling portion 136 functions as a third ring for tying the hair 10 in some embodiments.

The ring portion 130*a* is formed with a first sub-ring, a first ring 132 disposed in a direction opposite to the first sub-ring 138, a second sub-ring 139 disposed in a direction opposite to the first ring 132, and a second ring 134 disposed in a direction opposite to the second sub-ring 139 obtained by folding the thread 130 zigzag, and preferably forms a first ring pulling portion 136 through a step of passing an end of the thread 130 through the second sub-ring 139 from one side to the other side, a step of passing through the first sub-ring 138 from the other side to the one side after skipping the first ring 132, a step of passing through the first sub-ring 138 from the other side to the one side while enclosing the exterior thread portion 138*a* forming the first sub-ring 138 and changing a direction toward the second ring 134, a step of passing through the second sub-ring 139 from the one side to the other side after skipping the first ring 132, and a step of passing through the second ring 134 from the other side to the one side, and then the first sub-ring 138 and the second sub-ring 139 are tightened so as to be hooked to the first ring pulling portion 136 leaving the first ring 132 and the second ring 134.

Or, the ring portion 130*a* may be formed by tightening the first sub-ring 138 and the second sub-ring 139 after forming the first ring pulling portion 136, the second ring 134, the second sub-ring 139, the first ring 132, and the first sub-ring 138 with steps in a reverse order.

In attaching the hair extension 100 to the hair 10 of the user, it is desirable that the hair 10 is inserted into the second ring 134 in a direction opposite to the direction in which an end of the thread 130 forming the first ring pulling portion 136 extends out of the second ring 134 as shown in FIG. 3 and then into the first ring 132.

As an end of the first ring pulling portion 136 passes through the second ring 134 and extends externally to the right, if pulling the both ends of the thread to both sides, the first ring pulling portion 136 pulls the first ring 132 toward the second ring 134.

Here, preferably the first ring 132 is for forming a first knot tying the hair 10 of the user firstly; the second ring 134 is for forming a second knot which inserts a part of the hair 10 tied at the first knot into the second ring 134 and ties secondly; and the first ring pulling portion 136 pulls the first ring 132 with the hair inserted therein and the hair 10 tied at the first ring 132 toward the second ring 134 so as to tighten the second ring 134 and tie the hair 10 secondly.

In certain embodiments of the invention, the hair 10 tied to the first ring 132 and the first ring 132 is pulled toward the second ring 134 by the first ring pulling portion 136, not inserted into the second ring 134, but the first ring 132 pulls the hair 10 into the first ring pulling portion 136, and the hair 10 is tied to the first ring pulling portion 136 while folded, and in such a process, as the second ring 134 tightens, the corresponding portion of the hair 10 may be tied.

In this procedure, the hair 10 is tied in a shape of 'S' by intertwining with the first ring 132, first ring pulling portion 136, and the second ring 134. That is, even though the first knot by the first ring 132 is not inserted into the second ring 134, since the hair 10 is intertwined with the first ring 132, first ring pulling portion 136, and the second ring 134 and tied at least to the first ring pulling portion 136 and the second ring 134, there is no way for the hair 10 to be detached from the ring portion 130*a*.

Figure 10:
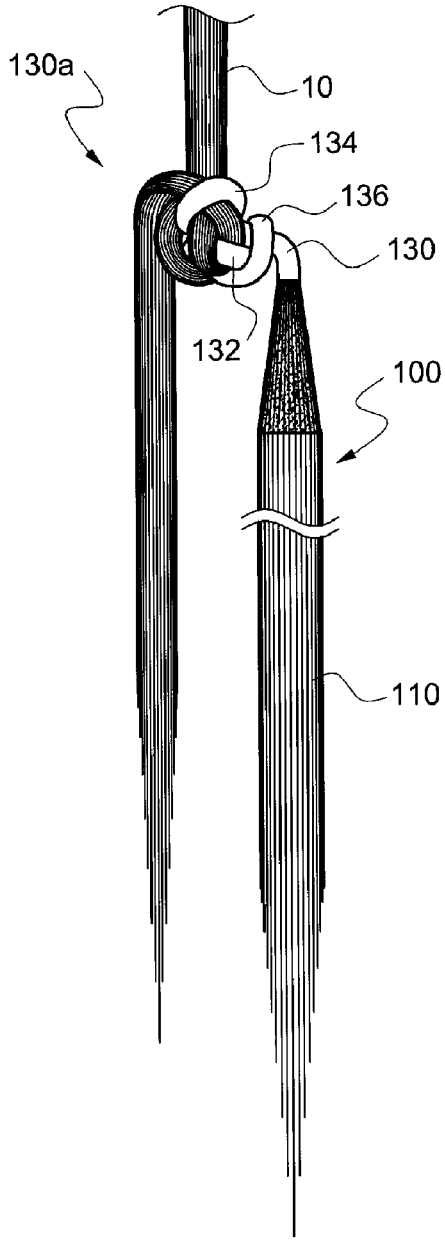
FIG. 10 shows attached an hair extension according to the invention to hairs of the user.

Whether the first ring 132 and the hair 10 tied at first ring 132 is inserted into the second ring 134, or not inserted but intertwined with the first ring 132, the first ring pulling portion 136, and the second ring 134 in a shape of 'S' and then tied may be determined by a plurality of factors including kind and thickness of the thread 130, number of strands of the hair 10 inserted into the first ring 132, speed of pulling the thread 130, direction of insertion of the hair 10 as shown in FIG. 3 or 10, etc.

Mode for Invention

Figure 4:
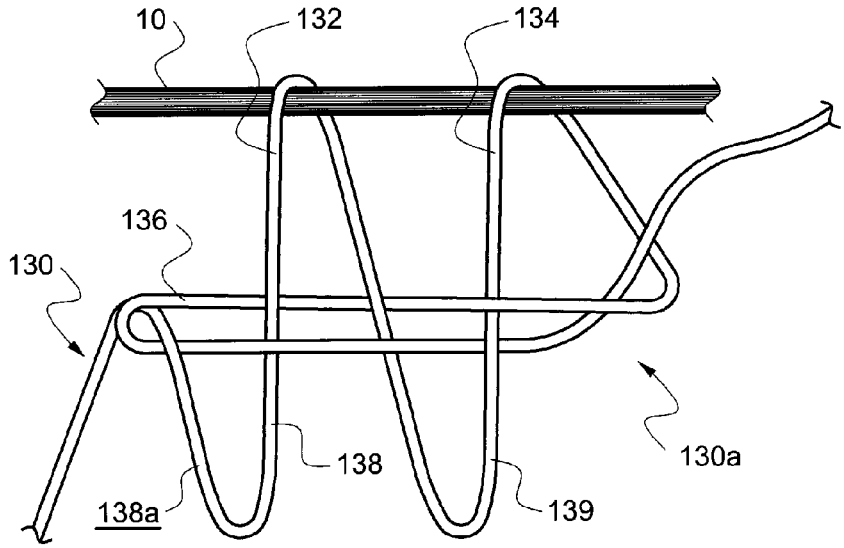
FIG. 4 illustrates a varied knotting of FIG. 3.

FIG. 4 illustrates a varied knotting of FIG. 3.

In certain embodiments of the invention, in forming the first ring pulling portion 136, the direction of first passing of the thread 130 through the second ring 134 may be reversed from that as in FIG. 3. In such a case, the direction of the last passing of the thread 130 through the second ring 134 is also reversed. The first ring 132 may be twisted once so as to make a closed line. These can be applied to the previous and later embodiments. The remaining is same as in FIG. 3.

Figure 5:
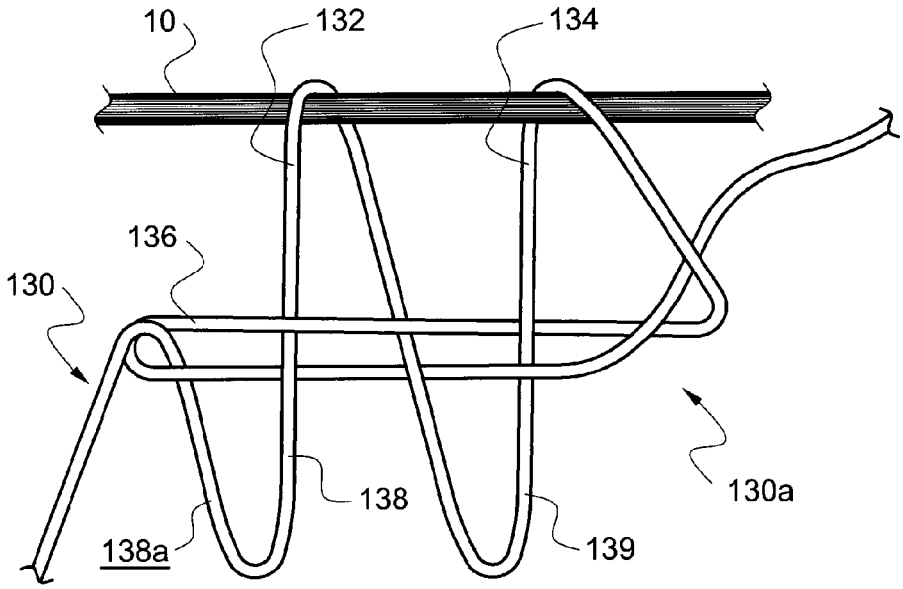
FIG. 5 illustrates a state of hair inserted into a second ring in a direction different from that of FIG. 3.

FIG. 5 illustrates a state of hair inserted into a second ring in a direction different from that of FIG. 3.

In certain embodiments of the invention, not like in FIG. 3, the hair 10 may be inserted at a location where the thread 130 of the first ring pulling portion 136 extends externally to the right. The remaining is the same as in FIG. 3.

Figure 11:
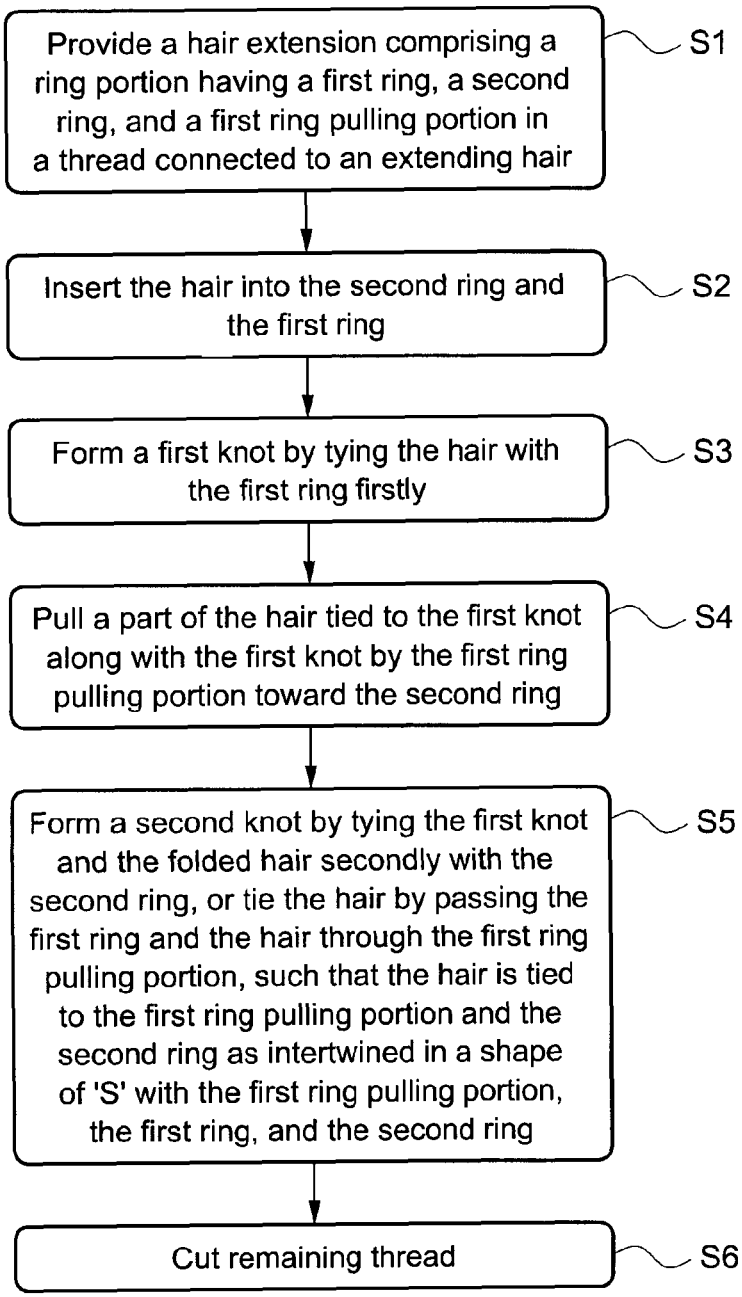
FIG. 11 is a block diagram for explaining the process of hair extension.

FIGS. 6-10 show steps of attaching hair extension according to the invention to hairs of the user in order and FIG. 11 is a block diagram for explaining the process of hair extension.

Referring to FIG. 2-11, the process of hair extension according to the present invention will be described below.

First, a plurality of hair extension 100 are draped from a rack (S1).

Figure 6:
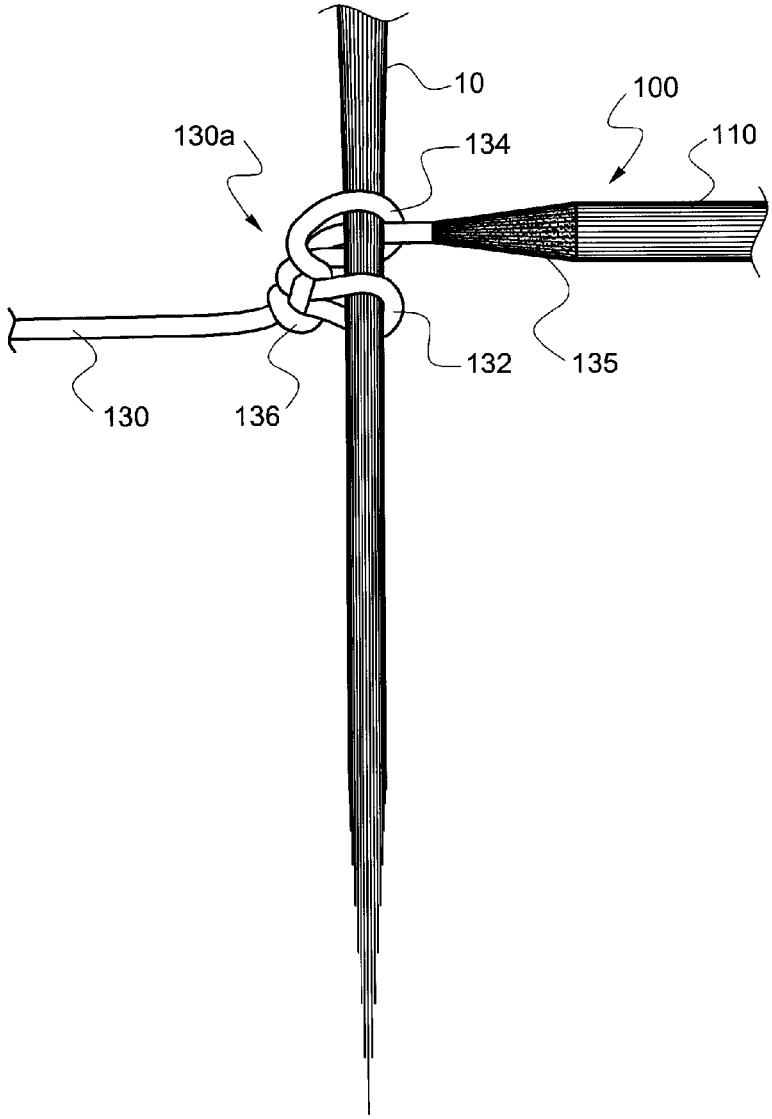
FIG. 6 illustrates the first step of attaching hair extensions according to the invention to hairs of the user.

Then as shown in FIG. 6, the hair 10 of the user is inserted into the first ring 132 and the second ring 134. There, a tool like knitting needle may be used to pass the end of the hair 10 of the user through the first ring 132 and the second ring 134 (S2).

Figure 7:
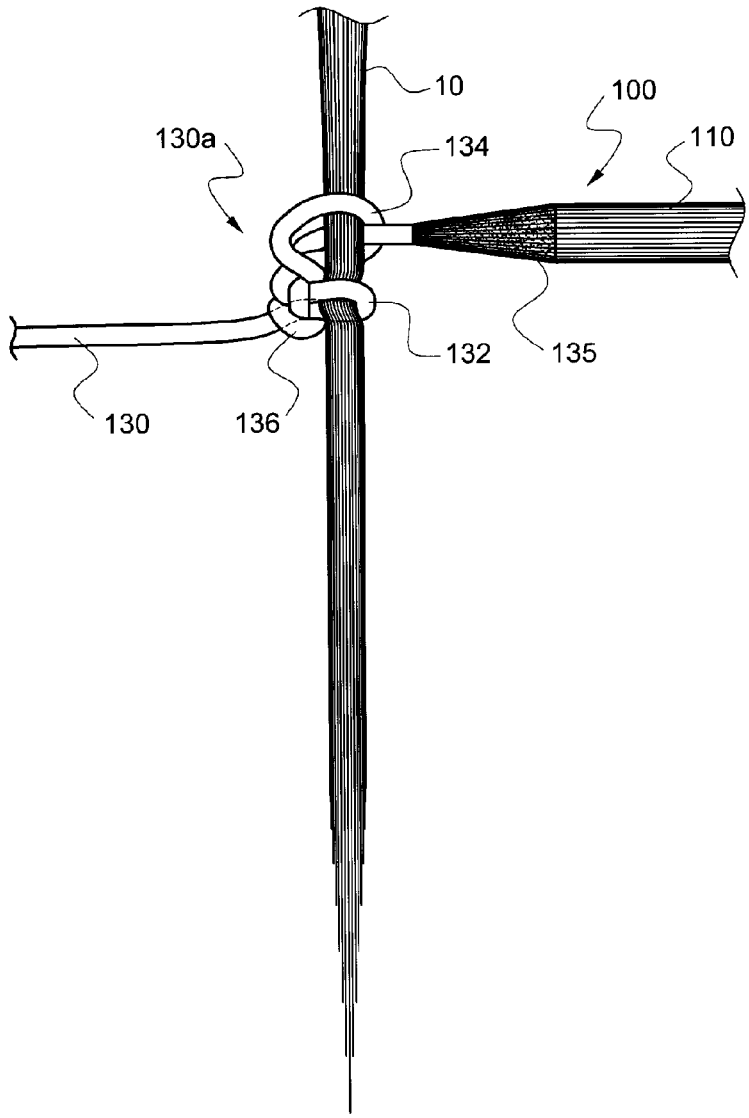
FIG. 7 shows the second step of attaching a hair extension according to the invention to hairs of the user.
Figure 8:
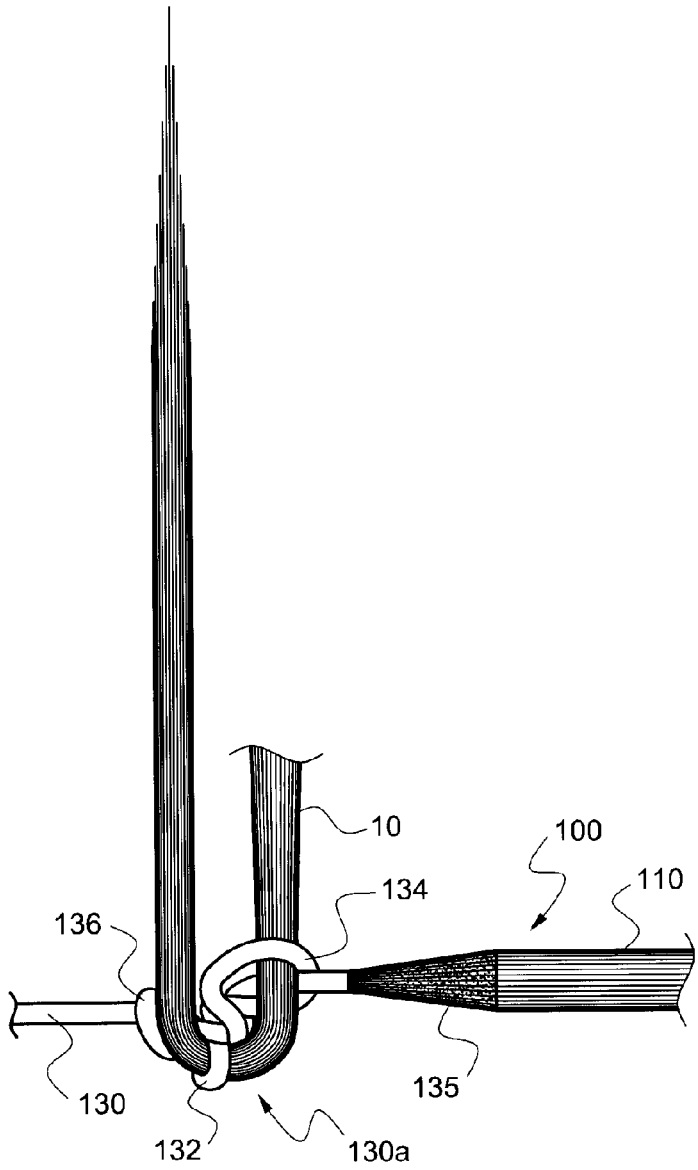
FIG. 8 shows the third step of attaching a hair extension according to the invention to hairs of the user.

First determine a location to attach the hair extension 100, the thread 130 at both sides of the ring portion 130*a* are pulled apart to opposite directions. Then the first ring 132 is tightened firstly and then the first knot by the first ring 132 is formed as shown in FIG. 7, and the lower portion of the hair 10 of the user is uplifted by a pulling force while the first ring 132 tightens as shown in FIG. 8 (S3).

Figure 9:
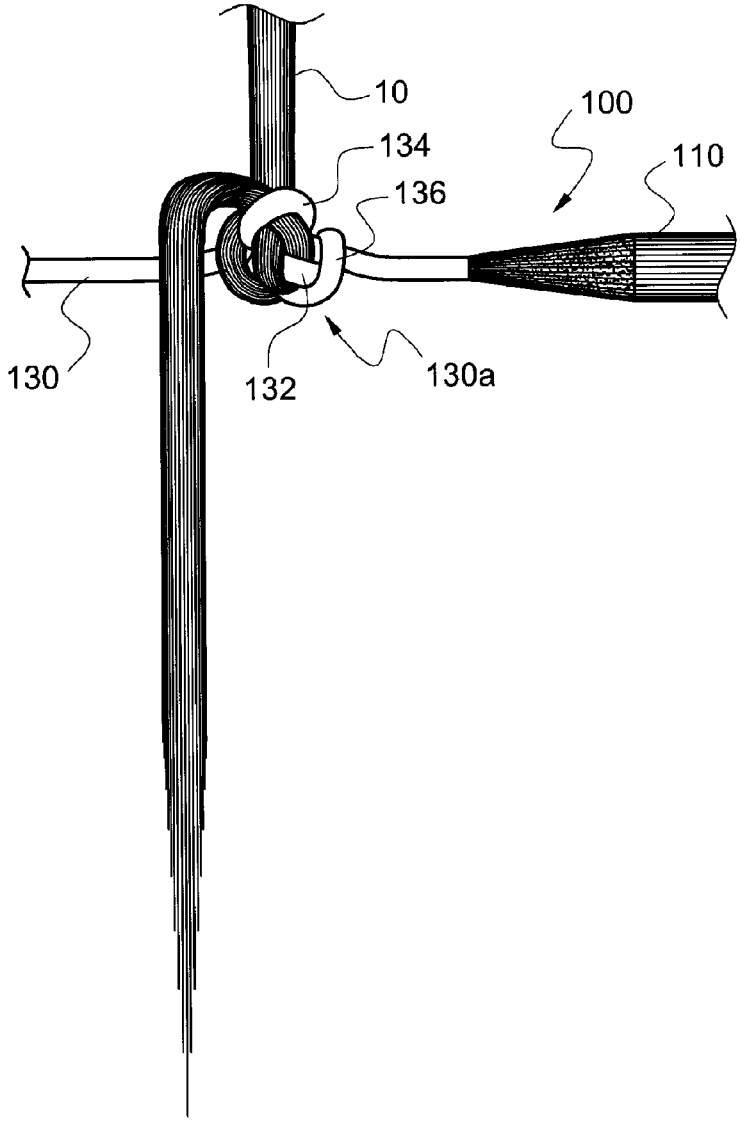
FIG. 9 shows the fourth step of attaching a hair extension according to the invention to hairs of the user.

As shown in FIG. 9, if the thread 130 at both sides of the ring portion 130*a* are pulled apart, the first ring pulling portion 136 pulls the hair 10 tied to the first ring 132 along with the first knot by the first ring 132 toward the second ring 134 with a part of the hair 10 folded (S4).

A part of the hair 10 tied to the first ring 132 as in the above is inserted into the second ring 134 along with the first ring 132 while folded, and the second ring 134 is tightened secondly, such that the second knot is formed by the second ring 134.

Figure 12:
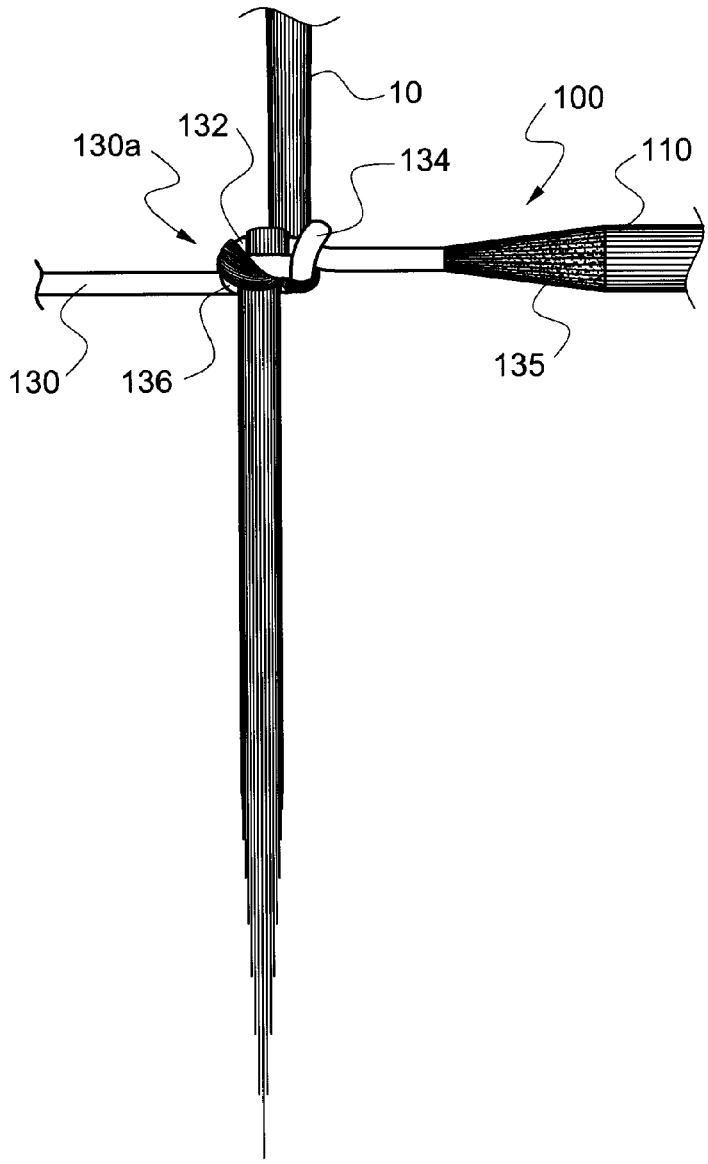
FIG. 12 illustrates a hair which passes through a first ring pulling portion and tied in a shape of 'S' to the first ring, first ring pulling portion, and second ring.

In certain embodiments of the invention, the first ring 132 and a part of the hair 10 tied to the first ring 132 are inserted into the first ring pulling portion 136 and then pulled toward the second ring 134, but while not inserted into the second ring 134, the hair 10 may be intertwined with the ring portion 130*a* in a shape of 'S' and tied with the first ring pulling portion 136 and the second ring 134 tightened. Since this is shown in FIG. 12, more description is not provided here. With the above, since the hair 10 intertwined with the first ring 132, the second ring 134, and the first ring pulling portion 136 in a shape of 'S' and tied to the first ring pulling portion 136 and the second ring 134, the hair 10 is tied to the ring portion 130*a* tightly (S5).

After forming the second knot by the second ring 134, if cutting away the remainders of the thread 130, the attachment of a single hair extension 100 is finished as shown in FIG. 10 (S6).

The hair extension 100 is attached to the hair 10 of the user by repeating the above procedure. In such a case, 4-5 hours with the conventional pre-bonded hair extension can be shortened to about 1 hour, and since two knots are formed and the hair 10 are intertwined with the thread 130, the knot is not dissolved even though the remainders of the thread 130 are cut away. Afterwards, as in the prior arts, styling procedures such as cutting can be performed in a beauty shop. It is easy to remove the hair extension 100 from the hair 10, for it can be done by cutting the thread at the knots with a pair of scissors.

FIG. 12 illustrates a hair which passes through a first ring pulling portion and tied in a shape of 'S' to the first ring, first ring pulling portion, and second ring.

As mentioned in the above, in certain embodiments of the invention, the first ring 132 which ties the hair 10 firstly may not pass through the second ring 134, but pass through the first ring pulling portion 136 with the hair 10 tied by the first ring 132, such that the hair 10 may be tied to the first ring pulling portion 136 while folded. In such a case, the first ring 132 is spread in a line to both directions while hooking the hair 10, and a part of the hair 10 is tied to the first ring pulling portion 136 while hooked in the first ring 132 and folded. Here, the second ring 134 is also tightened, and the hair 10 is intertwined with the first ring 132, the first ring pulling portion 136, and the second ring 134, and then tied to the first ring pulling portion 136 and the second ring 134 respectively.

The remaining processes of the attachment of hair extension according to the invention have been described referring to FIGS. 6-11.

Industrial Applicability

The present invention may be utilized in manufacturing and attaching of the hair extension.

The invention claimed is:

1. A hair extension comprising:

an extending hair portion; and a thread connected to the extending hair portion and configured to be tied to a user's hair under attachment, wherein a ring portion is formed between both ends of the thread for inserting the user's hair, tightening, and fixing to the inserted user's hair, wherein the ring portion is formed with a first sub-ring, a first ring disposed in a direction opposite to the first sub-ring, a second sub-ring disposed in a direction opposite to the first ring, and a second ring disposed in a direction opposite to the second sub-ring obtained by folding the thread in zigzag, and forms a first ring pulling portion through a step of passing an end of the thread through the second sub-ring from one side to the other side, a step of passing through the first sub-ring from the other side to the one side after skipping the first ring, a step of passing through the first sub-ring from the other side to the one side while enclosing the exterior thread portion forming the first sub-ring and changing a direction toward the second ring, a step of passing through the second sub-ring from the one side to the other side after skipping the first ring, and a step of passing through the second ring from the other side to the one side, or formed with the first ring pulling portion, the second ring, the second sub-ring, the first ring, and the first sub-ring with steps in a reverse order, and then the first sub-ring and the second sub-ring are tightened so as to be hooked to the first ring pulling portion leaving the first ring and the second ring.

2. The hair extension of claim 1, wherein the ring portion comprises a first ring for allowing insertion of the user's hair and tying the user's hair firstly, a second ring connected to the first ring and for allowing insertion of the user's hair and tying the user's hair secondly, and a first ring pulling portion, for pulling the first ring toward the second ring, which is connected to the second ring and covers the first ring, wherein an end is disposed to stick out externally through the second ring.

3. The hair extension of claim 1, wherein the first ring is for allowing insertion of the user's hair and tying the user's hair firstly, the second ring is connected to the first ring and for allowing insertion of the user's hair and secondly tying the user's hair as inserted into the second ring along with a part of the folded user's hair tied firstly, and the first ring pulling portion is for pulling the first ring into the second ring, which is connected to the second ring and covers the first ring, wherein an end is disposed to stick out externally through the second ring.

4. The hair extension of claim 1, wherein the first ring is for forming a first knot tying the user's hair firstly, and the second ring is for forming a second knot which inserts a part of the user's hair tied at the first knot into the second ring and ties secondly.

5. The hair extension of claim 1, wherein the user's hair is inserted into the first ring and the second ring, and then threads on both sides of the rings are pulled in opposite directions such that the first ring picks up the user's hair and drags the user's hair into the first ring pulling portion, so that the user's hair is tied to the first ring pulling portion and the second ring by pulling the first ring pulling portion and second ring further.

6. The hair extension of claim 5, wherein the user's hair may be tied to the first ring pulling portion and the second ring as intertwined in a shape of 'S' with the first ring pulling portion, the first ring, and the second ring.

* * * * *